US007134165B2

(12) United States Patent
Pullins

(10) Patent No.: US 7,134,165 B2
(45) Date of Patent: Nov. 14, 2006

(54) BAGLESS VACUUM CLEANER SYSTEM

(75) Inventor: Alan T. Pullins, Lexington, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 108 days.

(21) Appl. No.: 10/895,556

(22) Filed: Jul. 21, 2004

(65) Prior Publication Data

US 2005/0015921 A1 Jan. 27, 2005

Related U.S. Application Data

(60) Provisional application No. 60/489,287, filed on Jul. 22, 2003.

(51) Int. Cl.
*A47L 9/10* (2006.01)
*A47L 9/12* (2006.01)
*A47L 9/16* (2006.01)

(52) U.S. Cl. ..... 15/352; 15/351; 15/353; 55/323; 55/337

(58) Field of Classification Search ..... 15/327.1, 15/327.2, 327.6, 327.7, 347, 350–353; 55/321, 55/323, 337, 429, 482, DIG. 3
See application file for complete search history.

(56) References Cited

U.S. PATENT DOCUMENTS 3,543,325 A * 12/1970 Hamrick ..... 15/314
5,230,722 A 7/1993 Yonkers
5,363,535 A * 11/1994 Rench et al. ..... 15/344
6,003,196 A 12/1999 Wright et al.
6,026,540 A 2/2000 Wright et al.
6,070,291 A 6/2000 Bair et al.
6,260,234 B1 7/2001 Wright et al.
6,334,234 B1 * 1/2002 Conrad et al. ..... 15/347
6,341,404 B1 1/2002 Salo et al.
6,353,963 B1 3/2002 Bair et al.
6,401,295 B1 6/2002 Bair et al.
6,406,505 B1 * 6/2002 Oh et al. ..... 55/337
6,408,481 B1 * 6/2002 Dyson ..... 15/350
6,428,589 B1 8/2002 Bair et al.
6,436,160 B1 8/2002 Stephens et al.
6,463,622 B1 10/2002 Wright et al.
6,588,054 B1 7/2003 Bair et al.
6,591,446 B1 7/2003 Bair et al.
6,735,815 B1 5/2004 Bair et al.
6,735,817 B1 5/2004 Bair et al.
6,745,432 B1 6/2004 Wright et al.
6,868,578 B1 * 3/2005 Kasper et al. ..... 15/347
2001/0029845 A1 * 10/2001 Dyson et al. ..... 96/403
2002/0046438 A1 * 4/2002 Oh ..... 15/353

FOREIGN PATENT DOCUMENTS

JP 56-136642 10/1981
JP 56-136650 10/1981

* cited by examiner

*Primary Examiner*—Terrence R. Till
(74) *Attorney, Agent, or Firm*—King & Schickli, PLLC

(57) ABSTRACT

A vacuum cleaner includes a housing as well as a suction generator and bagless dirt system carried on the housing. The bagless dirt system includes a dirt cup, a prefilter, a filter chamber remote from the dirt cup, a filter in the filter chamber and a first conduit providing fluid communication between the dirt cup and the filter chamber. A second conduit provides fluid communication between the filter chamber and the suction generator.

11 Claims, 6 Drawing Sheets

50
88
92
106
90
108
110
94
94
36
100
88
34
94
90
94
100
92
96
88
86
100
98
100

BAGLESS VACUUM CLEANER SYSTEM

This application claims the benefit of U.S. Provisional Patent Application Ser. No. 60/489,287 filed on Jul. 22, 2003.

TECHNICAL FIELD

The present invention relates generally to the floor care equipment field and, more particularly, to an upright or canister vacuum cleaner equipped with a novel dirt collection assembly and such a dirt collection assembly.

BACKGROUND OF THE INVENTION

Bagless vacuum cleaner technology has long been known in the art. Japanese Patent Applications 56-136642 and 56-136650 both published in 1981 disclose an upright vacuum cleaner with a dirt collection chamber that removably connects to an opening of the main unit to facilitate user convenience during the emptying of the cleaner. A removable filter fills an opening at the bottom of the dirt chamber and serves to separate dirt from air drawn through the vacuum cleaner by the fan and motor assembly.

The present invention relates to an improved dirt collection assembly for an upright or canister vacuum cleaner.

SUMMARY OF THE INVENTION

In accordance with the purposes of the present invention as described herein, an improved vacuum cleaner is provided. That vacuum cleaner includes a housing, a suction generator carried on the housing and a bagless dirt system carried on the housing. The bagless dirt system includes a dirt cup, a filter chamber remote from the dirt cup, a filter in the filter chamber and a first conduit providing fluid communication between the dirt cup and the filter chamber. Further the vacuum cleaner includes a second conduit providing fluid communication between the filter chamber and the suction generator.

The filter chamber further includes an access door. The filter is held in a cavity in that access door. Further the access door includes an inlet in fluid communication with the first conduit. The access door is designed so that a dirt collection chamber is defined in the access door by the filter. The inlet is in direct communication with this dirt collection chamber.

The housing of the vacuum cleaner includes a nozzle assembly and a canister assembly. The canister assembly is pivotally connected to the nozzle assembly. The nozzle assembly includes a suction inlet. A rotary agitator is carried by the nozzle assembly across the suction inlet. Further, a prefilter may be provided in the dirt cup.

In the following description there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING FIGURES

The accompanying drawings incorporated in and forming a part of this specification illustrate several aspects of the present invention, and together with the description serves to explain certain principles of the invention. In the drawings.

Figure 3A:
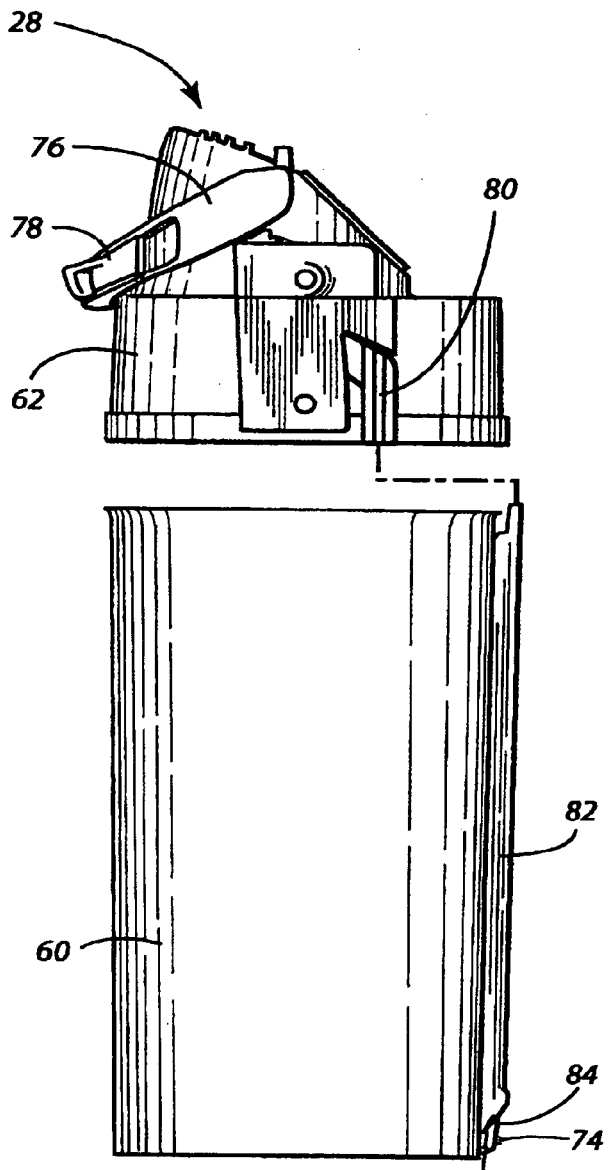
Figure 3B:
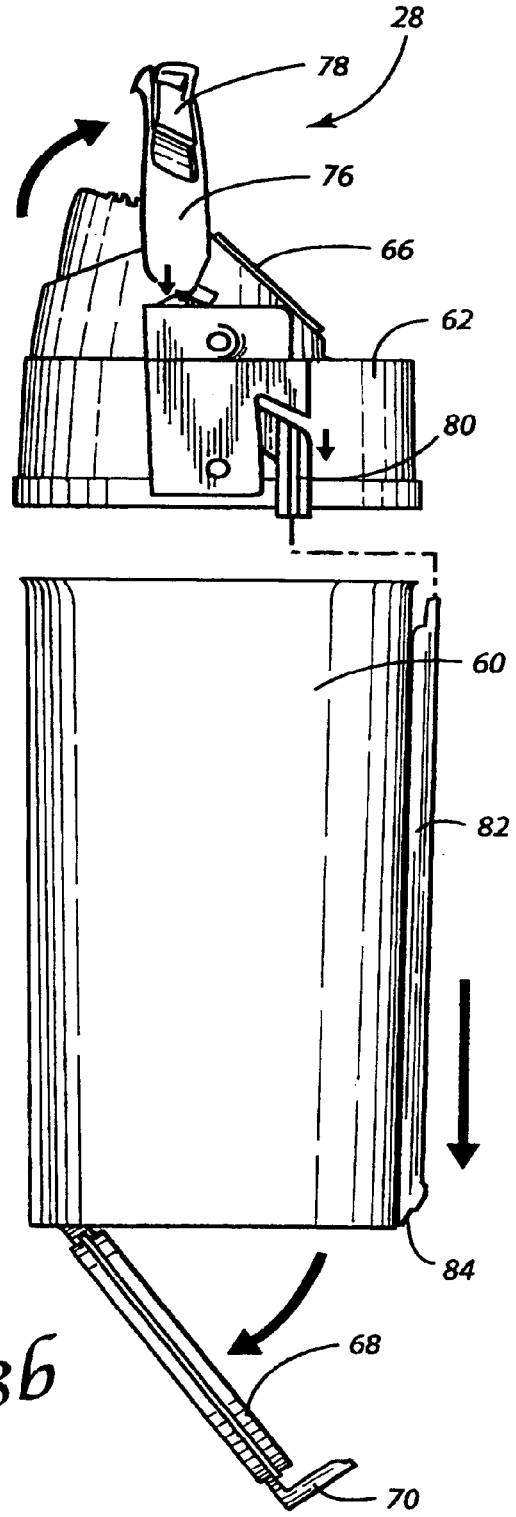
Figure 3C:
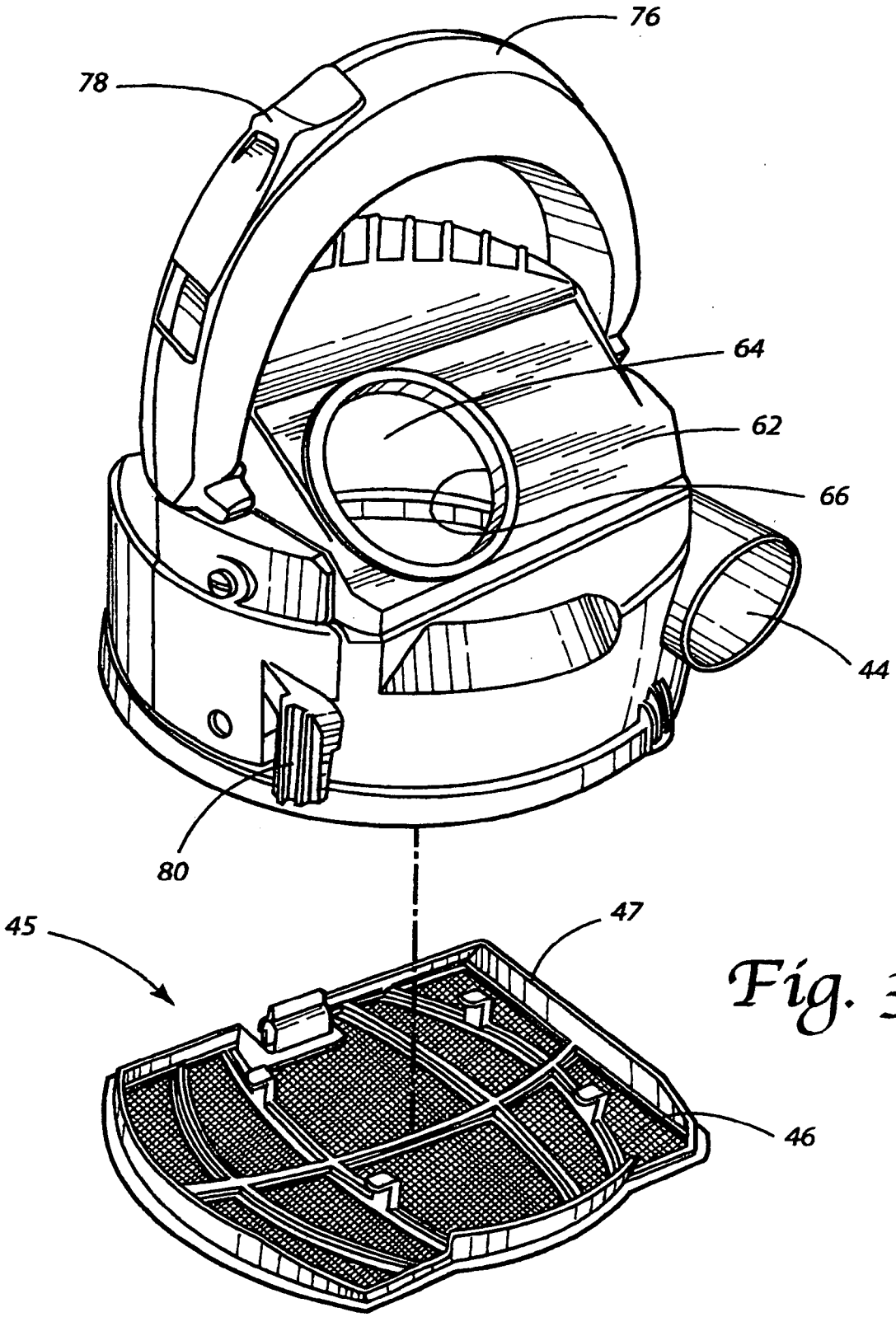
Figure 4:
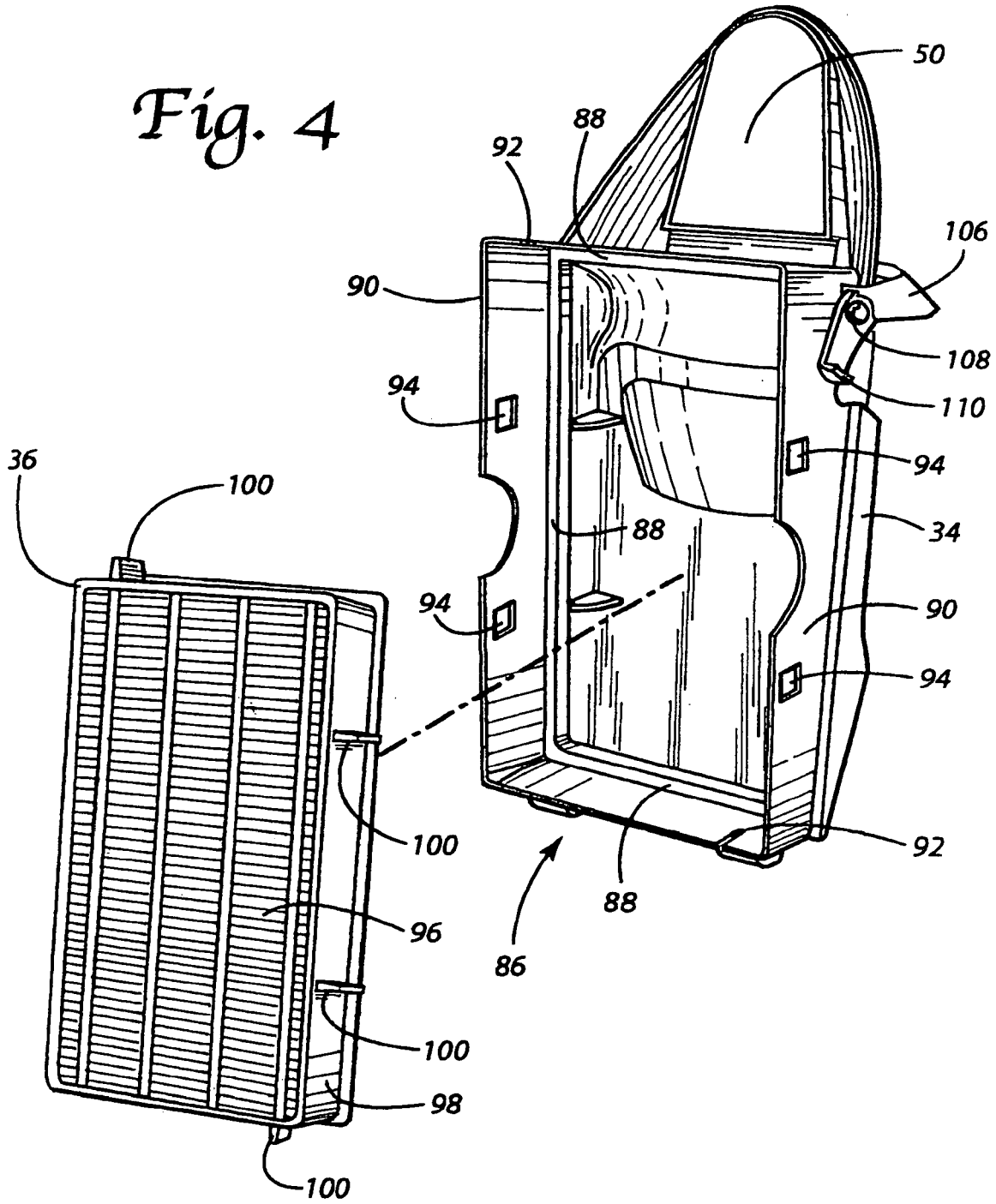
Figure 5:
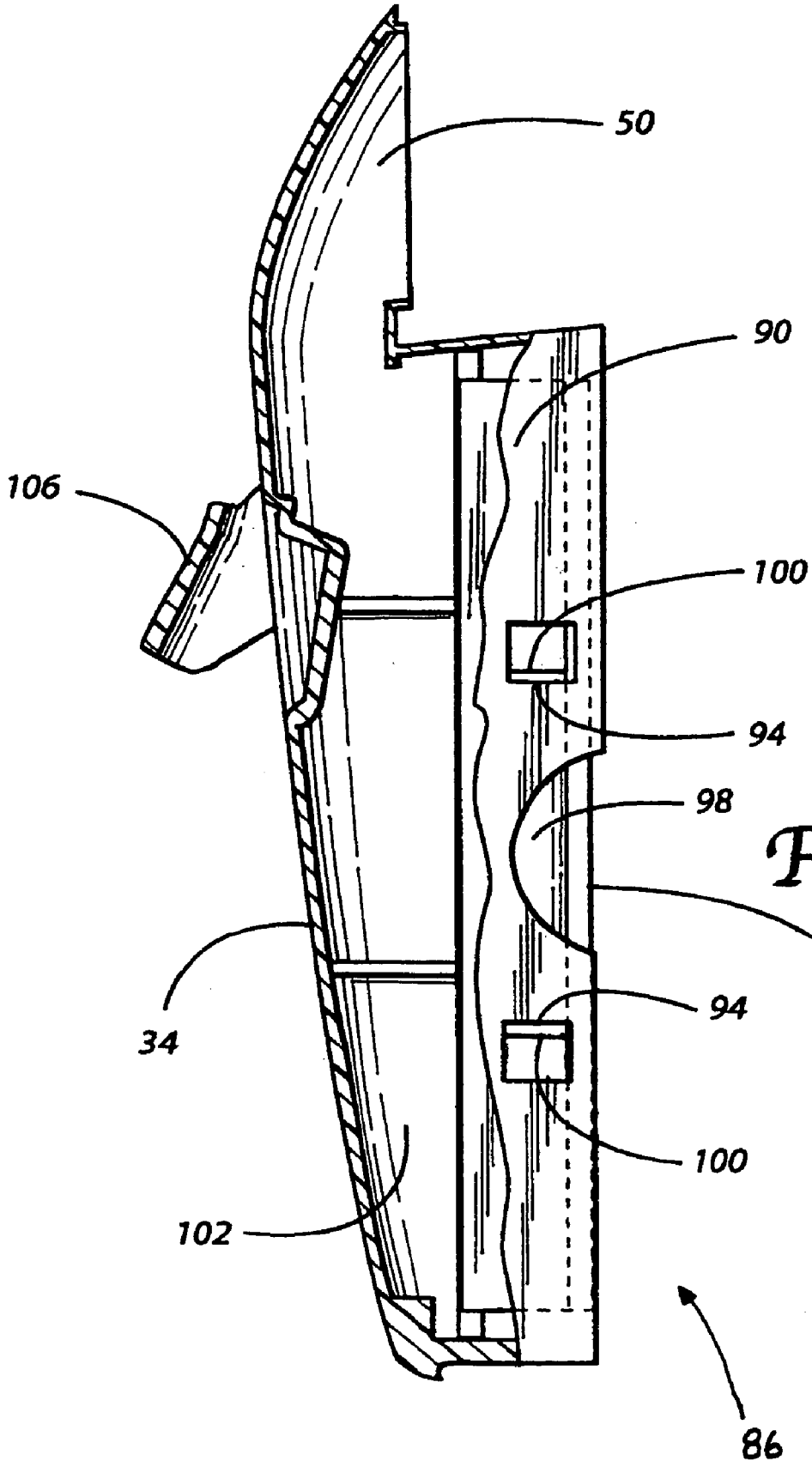

FIG. 3*a* is a side elevational view of the dirt cup removed from the housing;

FIG. 3*b* is a side elevational of the dirt cup with the bottom wall door opened for emptying the contents of the dirt cup;

FIG. 3*c* is a detailed, exploded perspective view of the lid of the dirt cup and the prefilter screen held in that lid;

FIG. 4 is a partially exploded perspective view of the access door including both the door and the filter held in the door; and FIG. 5 is a cross sectional view of the access door with the filter seated in the access door in its proper position.

Reference will now be made in detail to the present preferred embodiment of the invention, an example of which is illustrated in the accompanying drawing.

DETAILED DESCRIPTION OF THE INVENTION

Figure 1:
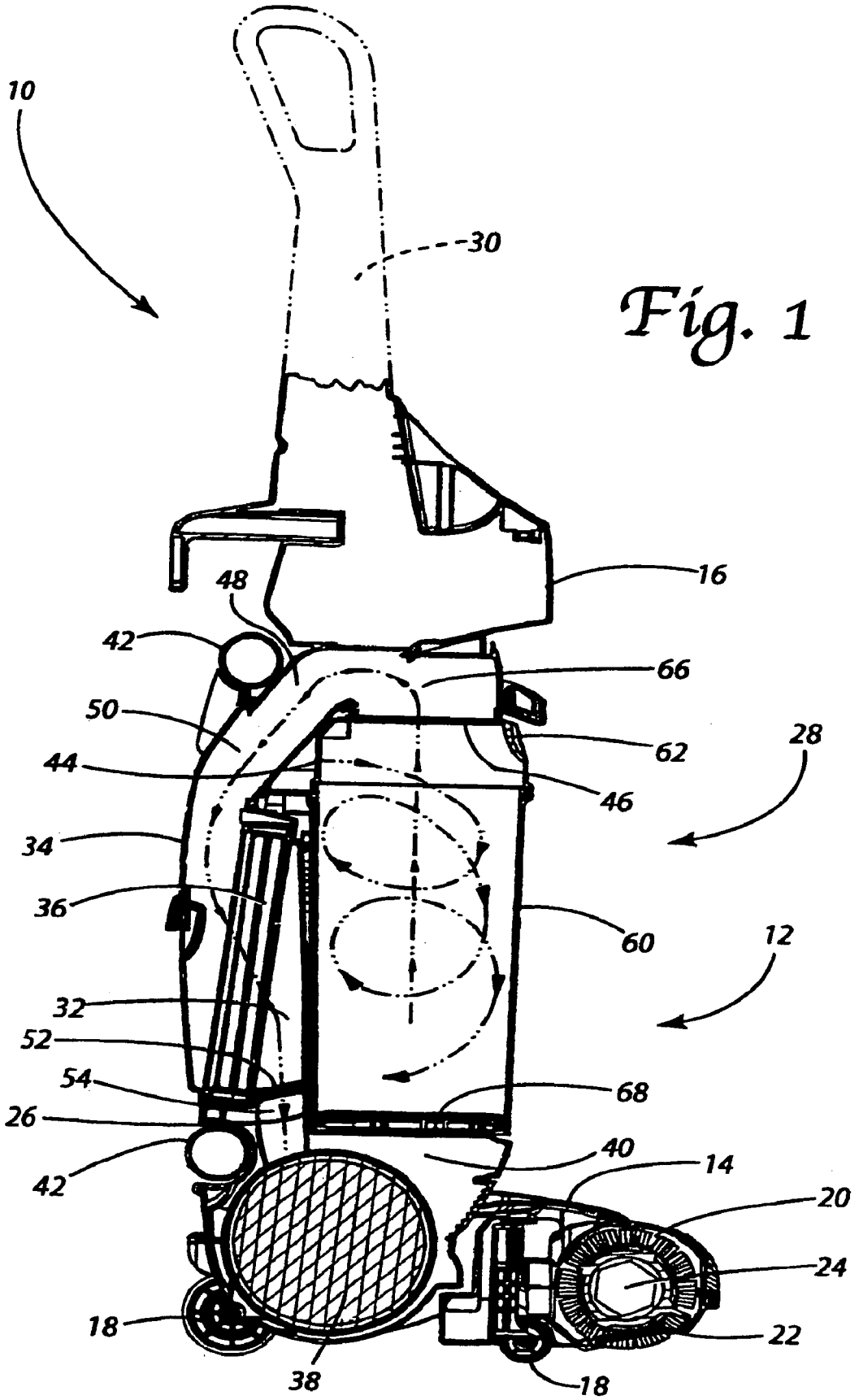
FIG. 1 is a schematical side cross sectional view of the vacuum cleaner of the present invention incorporating the new bagless dirt system.
Figure 2:
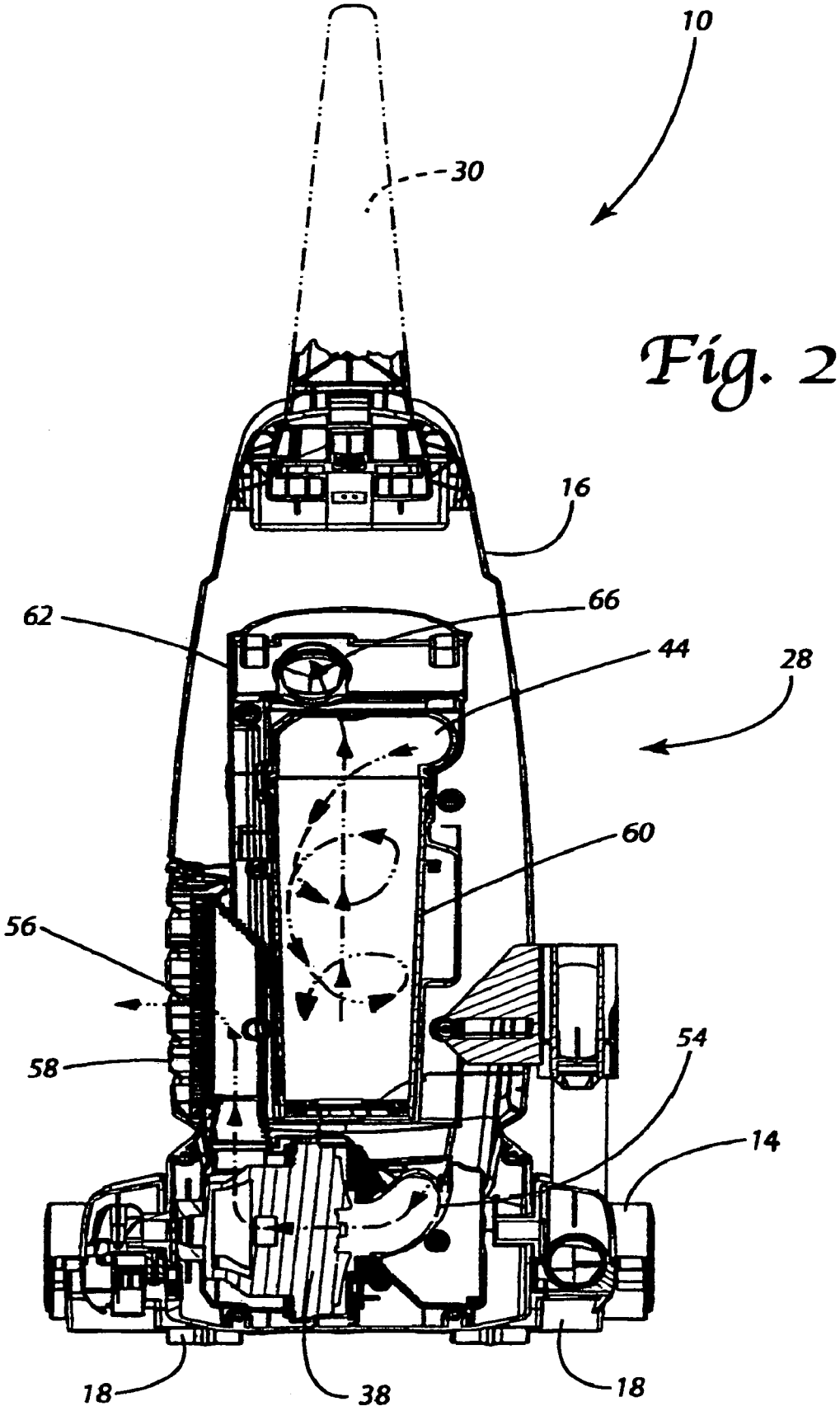
FIG. 2 is a schematical rear cross sectional view of the vacuum cleaner illustrated in FIG. 1.

Reference is now made to FIGS. 1 and 2 illustrating the vacuum cleaner 10 of the present invention. The vacuum cleaner 10 includes a housing 12 comprising a nozzle assembly 14 and a canister assembly 16. The canister assembly 16 is pivotally connected to the nozzle assembly 14 in a manner well known in the art. Wheels 18 provided on the housing 12 allow the vacuum cleaner to be moved smoothly and easily across the floor being cleaned. The nozzle assembly 14 includes a rotary agitator 20 that extends substantially across the entire width of a suction inlet 22. In the illustrated embodiment the rotary agitator 20 is driven by an internal drive motor 24.

As also illustrated in FIG. 1 the canister assembly 16 includes a cavity 26 for receiving and holding a dirt cup generally designated by reference numeral 28. A handle 30 is provided on the canister assembly 16 to allow the operator to conveniently guide the vacuum cleaner 10 back and forth across the floor during the cleaning operation. A filter chamber 32 is provided at the rear of the canister assembly 16 remote from the dirt cap 28. The filter chamber 32 is closed by an access door 34 that retains and holds a filter 36. A suction generator 38 is held in a compartment 40 at the bottom of the canister assembly 16. During operation, the rotary agitator 20 beats dirt and debris from the nap of an underlying carpet being cleaned. That dirt and debris is drawn with air into the suction inlet 22 by the suction generator 38. The air entrained with the dirt and debris travels from the suction inlet 22 through the feed conduit 42 by which it is delivered to the inlet 44 to the dirt cup 28. The majority of the dirt and debris is trapped in the dirt cup 28 and relatively clean air passes through the prefilter or screen 46 before traveling Through a first conduit 48 by which that air is delivered via an inlet 50 in the access door 34 to the filter chamber 32. The air then passes Through the filter 36 before traveling through the outlet 52, located in the canister assembly 16, into a second conduit 54. The second conduit 54 delivers the air to the compartment 40 housing the suction generator 38. The air is then directed over the motor of the suction generator 38 in order to provide cooling before being exhausted through a final filter 56 and then into the environment through an exhaust vent 58.

The dirt cup 28 is shown in detail in FIGS. 3*a*–3*c*. As illustrated the dirt cup 28 includes a cylindrical sidewall 60 having an open top end that receives a lid 62. An opening in the top of the lid 62 is closed by an optional prefilter 45 including a screen 46 supported by a frame 47. An exhaust manifold 64 on the downstream side of the prefilter 46 includes an outlet 66 that feeds air directly into the first conduit 48 leading to the filter chamber 32. Together the tangentially directed inlet 44 in the lid 62 and the cylindrical sidewall 60 induce a cyclonic airflow in the dirt cup 28 that assists in removing dirt and debris from the airstream. The bottom of the dirt cup 28 is closed by the dump door 68 pivotally mounted to the cylindrical sidewall 60. A resilient latch 70 opposite the hinge (not shown) engages a locking tab 74 on the sidewall 60 in order to hold the dump door 68 in a closed position.

When it is desired to empty the contents of the dirt cup, the dirt cup 28 is removed from the canister assembly 16 of the vacuum cleaner by lifting the handle 76 and pulling the dirt cup 28 outward. The dirt cup 28 is then held over a garbage can or other trash receptacle by the handle 76. The actuator 78 is then depressed. The actuator 78 engages a sliding actuating element 80 carried by the lid 62 which in turn engages a sliding link arm 82 carried on the sidewall 60. The link arm 82 includes a cam 84 at its distal end. Depression of the actuator 78 causes the cam 84 to engage the latch 70, thereby lifting the latch so that it clears the locking tab 74. Gravity acting on the dump door 68 and the contents of the dirt cup then causes the dump door to swing open allowing the contents to be dumped into the underlying trash receptacle. The dump door 68 is simply pushed closed to pivot it about the hinge and again secure it in position with the latch 70 engaging the locking tab 74. The dirt cup 28 is then replaced in the cavity 26 of the canister assembly 16 in order to continue the cleaning operation.

Reference is now made to FIGS. 4 and 5 illustrating the access door 34 of the filter chamber 32 removed from the canister assembly 16. As best illustrated in FIG. 4, the access door includes an inlet 50 and a filter holder 86. The filter holder 86 comprises a support shoulder 88 and a sidewall 90 including two slots 92 and four openings 94.

The filter 36 comprises a pleated filter media 96 held in a frame 98. The frame 98 includes a series of tabs 100. When the filter 36 is properly seated in the filter holder 86 (note FIG. 5), the tabs 100 are received in the slots 92 and openings 94 and the frame 98 rests against the shoulder 88. In this fully seated position, the filter 36 defines a dirt collection chamber 102 in the access door 34 in fluid communication with the inlet 50. Any small particles of dirt that might escape through the prefilter screen 46 become entrapped in this dirt collection chamber 102 behind the filter 36.

As further illustrated in FIGS. 4 and 5, the access door 34 includes a latch 106 pivotally connected thereto by means of trunnions 108. Lugs 110 provided on the latch engage a cooperating structure on the housing of the canister assembly 16 in order to secure the access door 34 in position and close the filter chamber 32.

Advantageously, the present invention provides a vacuum cleaner with a bagless dirt system including a dirt cup 28 and a separate filter chamber 32 that functions together to provide enhanced cleaning performance through the provision of dual filtration. Further, the dirt cup 28 is provided with a dump door 68 and the filter chamber 32 includes a removable access door 34 that holds the filter 36. These features allow the operator to conveniently empty the dirt cup 28, empty the dirt collection chamber 102 and change the filter 36 as necessary in a quick and efficient manner.

The foregoing description of the preferred embodiment of this invention has been presented for purposes of illustration and description. It is not intended to be exhaustive or to limit the invention to the precise form disclosed. Obvious modifications or variations are possible in light of the above teachings. For example, while the vacuum cleaner 10 illustrated and described in this document is an upright vacuum cleaner, it should be appreciated that the present invention is equally applicable to canister vacuum cleaners or even extractors. Further, while the dirt cup 28 in the illustrated embodiment takes advantage of cyclonic airflow, the present invention is equally applicable to and includes non-cyclonic dirt cups including those that do not incorporate cylindrical sidewalls and/or tangentially directed inlets.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A vacuum cleaner, comprising:

a housing;

a suction generator carried on said housing; and a bagless dirt system carried on said housing, said bagless dirt system including a dirt cup, a filter chamber remote from said dirt cup, a filter in said filter chamber and a first conduit providing fluid communication between said dirt cup and said filter chamber, said filter chamber further including an access door, an inlet in said access door in fluid communication with said first conduit and an outlet in said housing in fluid communication with said suction generator.

2. The vacuum cleaner of claim 1 further including a second conduit providing fluid communication between said filter chamber and said suction generator.

3. The vacuum cleaner of claim 2, wherein said filter is held in a cavity in said access door.

4. The vacuum cleaner of claim 3, wherein said access door is removable from said housing with said filter.

5. The vacuum cleaner of claim 1, wherein a dirt collection chamber separate from said filter is defined in said access door by said filter, said inlet being in direct communication with said dirt collection chamber.

6. The vacuum cleaner of claim 1, wherein said housing includes a nozzle assembly and a canister assembly.

7. The vacuum cleaner of claim 6, wherein said canister assembly is pivotally connected to said nozzle assembly.

8. The vacuum cleaner of claim 7, wherein said nozzle assembly includes a suction inlet.

9. The vacuum cleaner of claim 8, wherein a rotary agitator is carried by said nozzle assembly across said suction inlet.

10. The vacuum cleaner of claim 1, wherein said access door carries a latch for securing said access door to said housing.

11. The vacuum cleaner of claim 1, further including a prefilter mounted in said dirt cup.

* * * * *